US007032782B1

(12) United States Patent
Ciavarella et al.

(10) Patent No.: US 7,032,782 B1
(45) **Date of Patent: *Apr. 25, 2006**

(54) HOLDER FOR AEROSOL DISPENSER

(75) Inventors: Nick E. Ciavarella, Seven Hills, OH (US); Rexford R. Mast, Wooster, OH (US); Richard C. Sayers, Akron, OH (US)

(73) Assignee: Joseph S. Kanfer, Richfield, OH (US)

( * ) Notice: Subject to any disclaimer, the term of this patent is extended or adjusted under 35 U.S.C. 154(b) by 245 days.

This patent is subject to a terminal disclaimer.

(21) Appl. No.: 10/603,255

(22) Filed: Jun. 26, 2003

Related U.S. Application Data

(63) Continuation-in-part of application No. 10/042,679, filed on Jan. 11, 2002, now Pat. No. 6,581,804.

(51) Int. Cl.
*B67D 5/06* (2006.01)

(52) U.S. Cl. ..... 222/181.3; 222/183; 222/402.1

(58) Field of Classification Search ..... 222/181.1, 222/181.2, 181.3, 183, 402.1, 402.13
See application file for complete search history.

(56) References Cited

U.S. PATENT DOCUMENTS 3,368,720 A * 2/1968 Moll ..... 222/181.3
3,814,297 A * 6/1974 Warren ..... 222/402.13
4,678,106 A * 7/1987 Newell et al. ..... 222/162
5,377,871 A * 1/1995 Banks et al. ..... 222/41
5,431,304 A * 7/1995 Gentile ..... 222/103
6,237,812 B1 * 5/2001 Fukada ..... 222/181.2
6,305,580 B1 * 10/2001 Chen ..... 222/162
6,581,804 B1 * 6/2003 Ciavarella et al. ..... 222/181.3

* cited by examiner

*Primary Examiner*—Joseph A. Kaufman
(74) *Attorney, Agent, or Firm*—Renner, Kenner, Greive, Bobak, Taylor & Weber

(57) ABSTRACT

A container holder assembly for removably receiving a product dispensing container having a flexible nozzle spout includes a wall-mounting back plate having a longitudinal axis and a container holder for receipt of the dispensing container hingedly attached to the back plate. The container holder has a through central bore for receipt of the dispensing container and the longitudinal axis of that bore is disposed at an angle with respect to the longitudinal axis of the back plate so that the container, when inserted, is disposed at an angle with regard to that axis and with regard to any vertical surface supporting the back plate. The product dispensing container is inserted into the container holder in an inverted condition so that the flexible nozzle projects below the container holder whereby, when the container holder is moved toward the back plate, the nozzle will contact a portion of the back plate and be deflected to dispense product. The back plate is essentially L-shaped in elevation and has a notch on its extending lower leg so that the nozzle is received within that notch and contacts the surface thereof to cause the deflection.

11 Claims, 4 Drawing Sheets

HOLDER FOR AEROSOL DISPENSER

RELATED PATENT APPLICATIONS

This application is a continuation-in-part of application Ser. No. 10/042,679 filed Jan. 11, 2002, now U.S. Pat. No. 6,581,804.

FIELD OF THE INVENTION

This invention relates in general to wall-mounted dispensers for removably receiving expendable containers containing the product to be dispensed therefrom and, more particularly, relates to a wall-mounted dispenser holder for receipt of an aerosol can or container having a flexible dispensing nozzle disposed on one end.

DESCRIPTION OF THE PRIOR ART

Aerosol dispenser containers are well-known in the prior art and generally consist of a can or other container for containing the product to be dispensed through a flexible tip or nozzle disposed on one end of the container so that when the container is used in a free-standing or hand held condition, it is simply necessary to deflect the flexible nozzle to cause the emission of a charge of the material.

When it is desired to mount dispensers of this type on a wall or other vertical support surface various holders are employed. Such holders generally comprise a body or housing with a central bore for receipt of the container. A back plate having a planar surface either as a separate piece or as part of the body or housing with the planar surface mounted against a wall or other vertical surface is provided. The actual container bearing the product is then inserted into the central bore of the body or housing with the nozzle projecting therefrom for access.

At that point, dispensing of the material is simply achieved by deflecting the flexible nozzle with the hand or fingers of the users to discharge a charge of the product.

Obviously, it is generally desirable to dispense the product onto the hand of the user, and often in the prior art, it is difficult to do this with any consistency. Essentially, some arrangements would require the use of both hands, one to deflect the nozzle and the other to receive the charge. Alternatively, if a single hand is employed, the difficulty is in accurately deflecting the flexible nozzle so as to ensure that the product is deposited where desired. The result is wastage of the material, splattering or spray of the material other than into the hand of the user, etc.

Furthermore, conventional arrangements involve actual hand or finger contact with the nozzle thus creating a potential point for transmission of germs from one user to the next. This is obviously undesirable particularly when the combination is mounted in public places.

Therefore, it is believed desirable to provide a means for wall-mounting a dispenser container of this general type so that the container is easily removable when the supply or contents are exhausted but where also a consistent dispensing action can be provided using one hand without any mess or misdirection of the material and without any physical contact with the dispensing nozzle.

SUMMARY OF THE INVENTION

It accordingly becomes a principal object of this invention to provide a dispenser holder for an aerosol container which can be wall-mounted, in which deflection of the flexible nozzle is controlled to cause consistent, accurate dispensing of the product contained therein.

It has been found that this object can be facilitated providing a back plate with first and second legs, the second leg of which extends outwardly from the bottom end of a first leg substantially normally thereto and contains a notch for receipt of the flexible nozzle when the container is mounted. The first leg is planar and is designed to be mounted on a vertical support surface.

It has further been found that provision of a container holder with a through central bore for receiving the body of the container with the nozzle projecting from the lower end thereof can be hingedly attached to the second leg of the back plate so that the holder itself may swing toward and away from the back plate as desired upon applying force from the heel of the hand of the user to the exterior of the container holder to force the nozzle into the notch in the back plate to deflect the flexible nozzle and dispense material.

It has also been found that some lateral movement of the container holder relative to the back plate can be achieved by connecting the holder and the back plate loosely to the back plate to insure that the deflection of the nozzle is accurately controlled even if the container holder is contacted off center.

Accordingly, production of an improved container holder assembly of the character above described becomes the principal object of this invention, with other objects thereof becoming more apparent when interpreted in view of the following brief description considered and interpreted in view of the accompanying drawings.

OF THE DRAWINGS

BRIEF DESCRIPTION OF THE PREFERRED EMBODIMENTS

Figure 1:
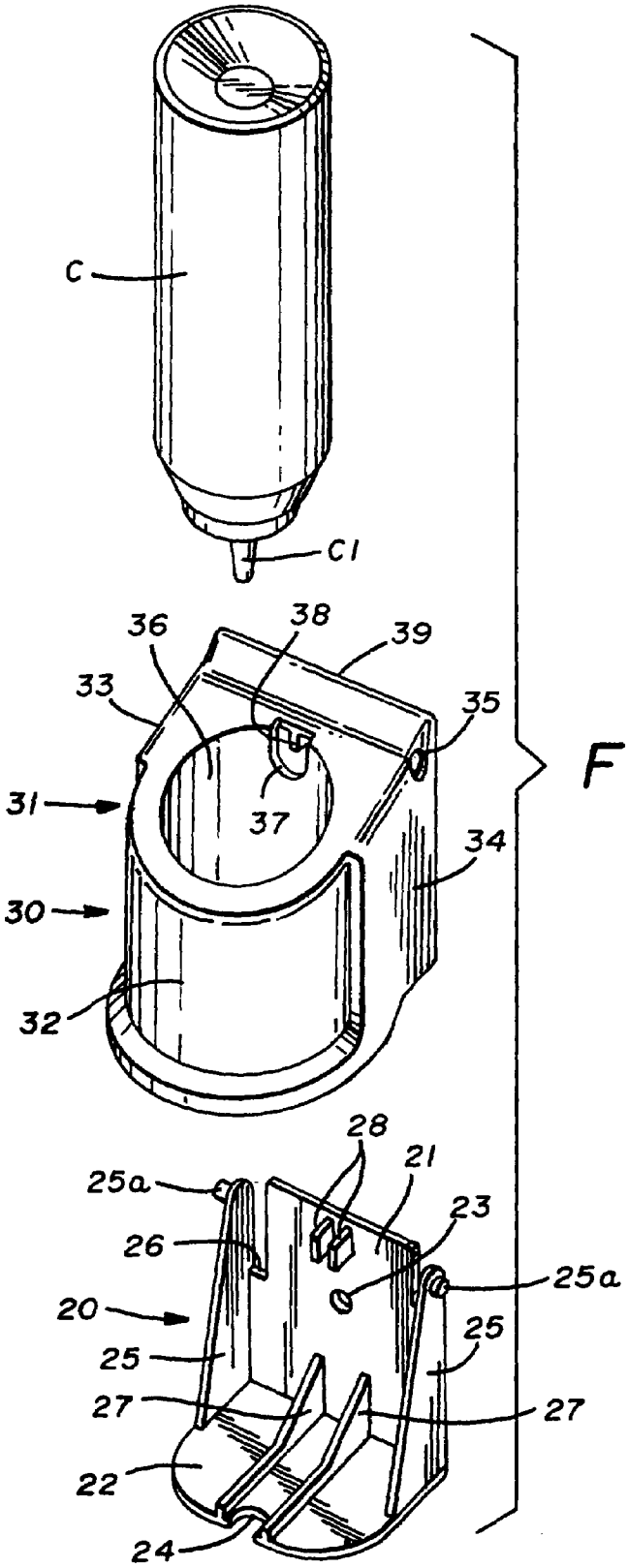
FIG. 1 is an exploded view of the assembly showing the container, the container holder, and the back plate.
Figure 2:
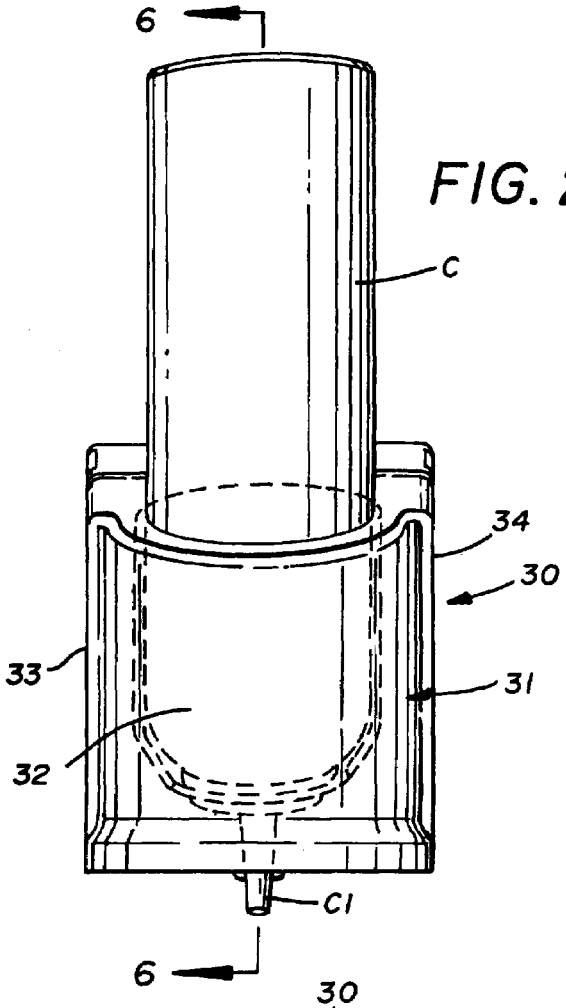
FIG. 2 is a front elevational view showing the container in place in the assembled back plate and holder body combination.
Figure 4:
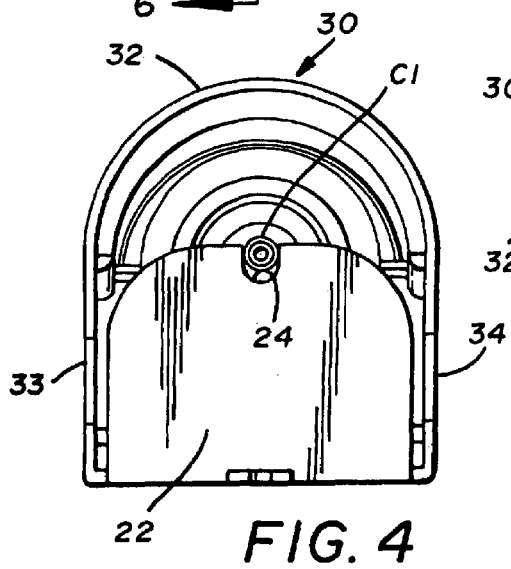
FIG. 4 is a bottom plan view taken from the bottom of FIG. 3.

It will be noted from FIG. 1 of the drawings that the principal components of the invention per se comprise the back plate 20 and the holder 30, both of which cooperate to receive a container C, as will be more fully described below.

To that end, the back plate 20 is essentially L-shaped and generally comprises a first leg 21 and a second leg 22 which are disposed at substantially right angles to each other. The one leg of the back plate 20 is an elongate, planar member which has at least one through aperture 23 for receipt of a mounting screw or similar device for wall mounting purposes, although it will be understood that the back plate 20 could be mounted to a vertical support surface in other ways.

The second leg 22 is also substantially flat and has a notched area 24 extending inwardly from its distal peripheral edge surface for purposes which will be described.

Side walls 25, 25 are also provided on second leg 22. These walls extend upwardly from the second leg 22 and carry stub axles 25*a*, 25*a* on their top edges, which are intended to cooperate with the holder 30 so as to mount the parts pivotally with regard to each other. Also, central strengthening and locating ribs 27, 27 are provided and extend between and interconnect the first and second legs 21 and 22. Locating projections 28, 28 are also located adjacent to top of the back leg 21 for purposes which will also be described more fully below.

Turning then to a description of the holder 30, it will be noted that it has a main body housing 31 and an arcuate outer surface portion 32, which also serves as a push bar surface for application of the palm of the user as will be described further below. Extending rearwardly from the arcuate outer surface portion 32 are side walls 33, 34. Notches or holes are provided in side walls 33 and 34 adjacent their top edges and designated by the numeral 35 for receipt of the stud axles 25*a* and 25*a* of the back plate 20, which will permit these two members to be hingedly but releasably secured together.

A hollow central housing is also provided and indicated by the numeral 36, and this housing also has a cutout area adjacent the rear wall 39 and indicated by the numeral 37, with a rib 38 projecting downwardly therefrom. It will be understood that this rib 38 is intended, when the parts are assembled together, to extend between the projections 28, 28 of the back plate 20.

Figure 3:
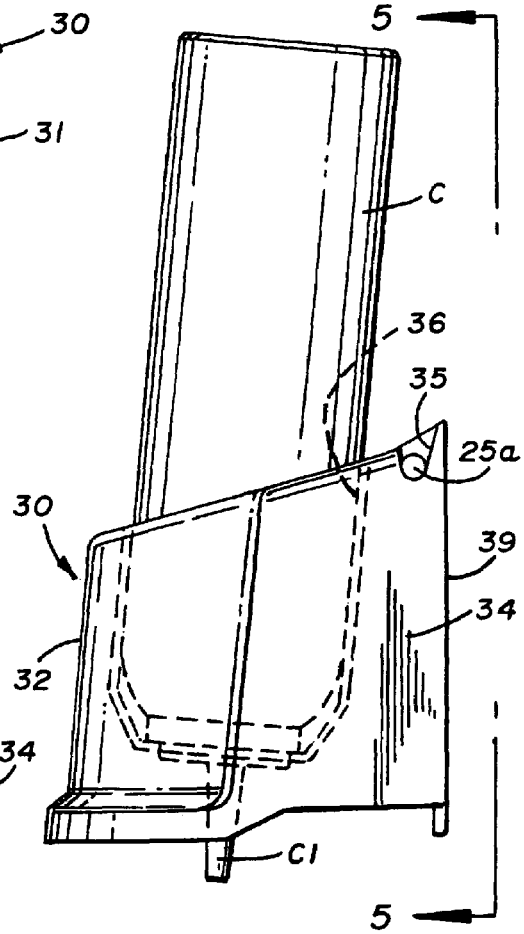
FIG. 3 is a side elevational view also showing the assembled container holder body and back plate.
Figure 6:
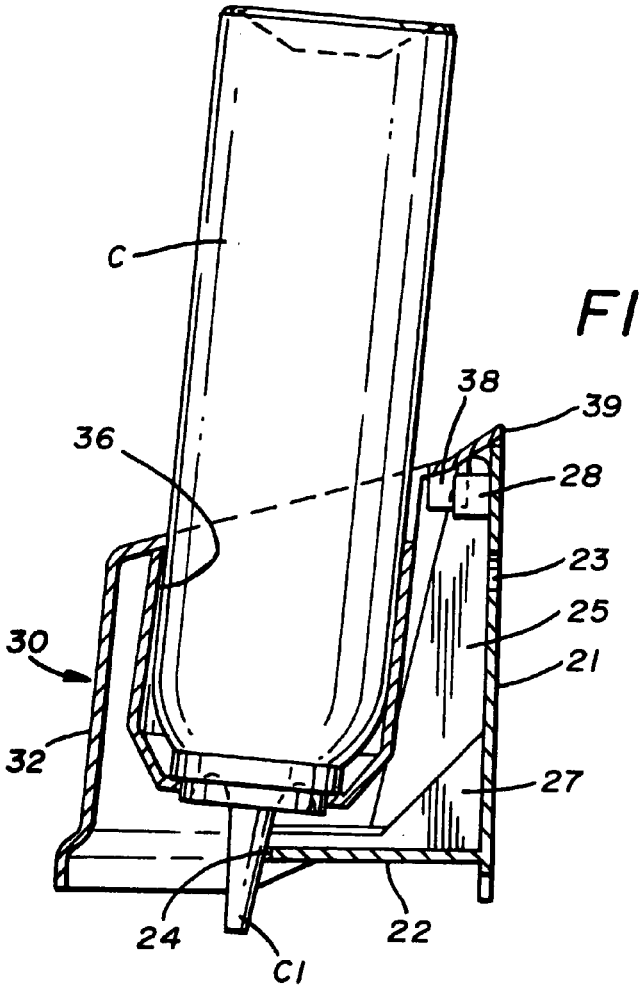
FIG. 6 is a sectional view taken along the line 6—6 of FIG. 2.
Figure 5:
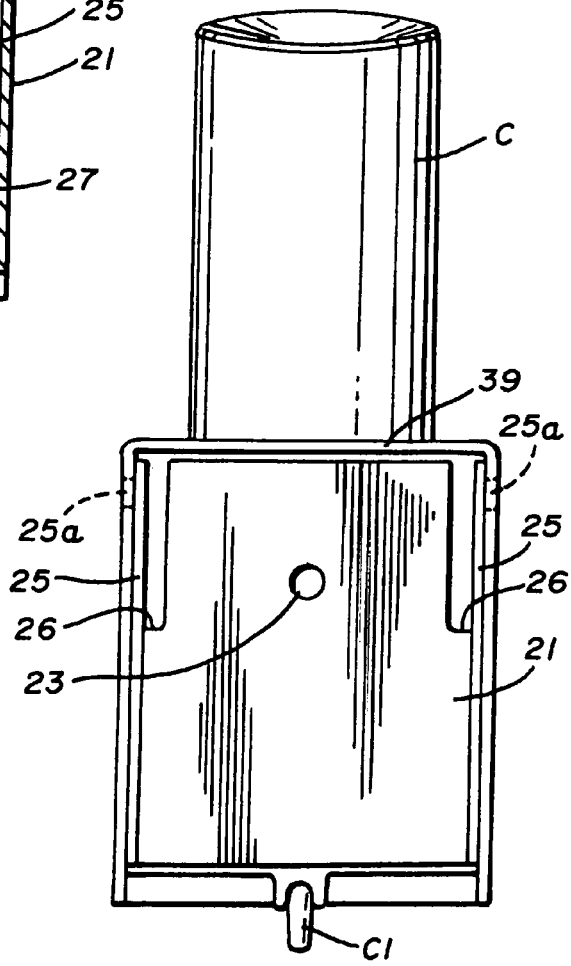
FIG. 5 is a rear elevational view of the improved assembly.

It will further be noted from FIG. 3, for example, that the through bore of housing 36 has a central axis which extends from the top to the bottom thereof and that this axis is disposed is such as to render the bore at an angle with respect to the planar back surface 39 and is sized so as to receive the body of container C.

The bore itself may not pass all the way through the housing body 31 at its full diameter but may be necked in adjacent its bottom to roughly conform to the configuration of the top end of the container C. In any event, the bore does extend in the reduced diameter to the bottom end of the housing 36, so as to permit the nozzle C1 to project through the notched area 24 in second leg 22 of the back plate 20, as shown in FIG. 3 of the drawings for example.

Accordingly, once the container has been deposited in the housing 36 and the holding 30 assembled to the back plate 20 as shown, for example, in FIG. 3, pressure applied to the outer arcuate surface 32 of the holder will cause the entire holder to pivot about the stub axles 25*a* and move toward the rear wall 21 of the back plate. This will force the nozzle C1 against the edge of the notch 24 of the back plate 20 and thereby deflect the nozzle to discharge the material. If the heel of the hand of the user is applied to the outer arcuate surface of the holder which then serves as a push bar that will automatically place the fingers of the user beneath the nozzle C1, and, therefore, the container contents will be accurately deposited directly onto the fingers, which is the desired location.

It will also be noted that by this arrangement, for sanitary reasons, it is significant that the nozzle C1 itself remains untouched by the user. This is particularly relevant when the dispenser is to be used in public washrooms or the like by successive users.

As previously noted, this construction also makes it possible to permit some lateral movement between the holder and the back plate inasmuch as the notches 26 of the back plate permit some controlled play from side to side through the interaction of the rib 38 and the projections 28, 28. In this fashion, while dispensing action can be effectuated even if the user does not strike the push bar at precisely the apex of the curved surface of the holder, the nozzle C1 can still be deflected to dispense material, and the positioning of the fingers of the recipient will still be precise. The interaction of the rib 38 and the projections 28, 28, however, prevent excess movement which might effectively damage the nozzle.

In this fashion, any conventional container can be used as such a holder by simply inverting it and inserting it into the housing 36 of the holder 30.

Figure 7:
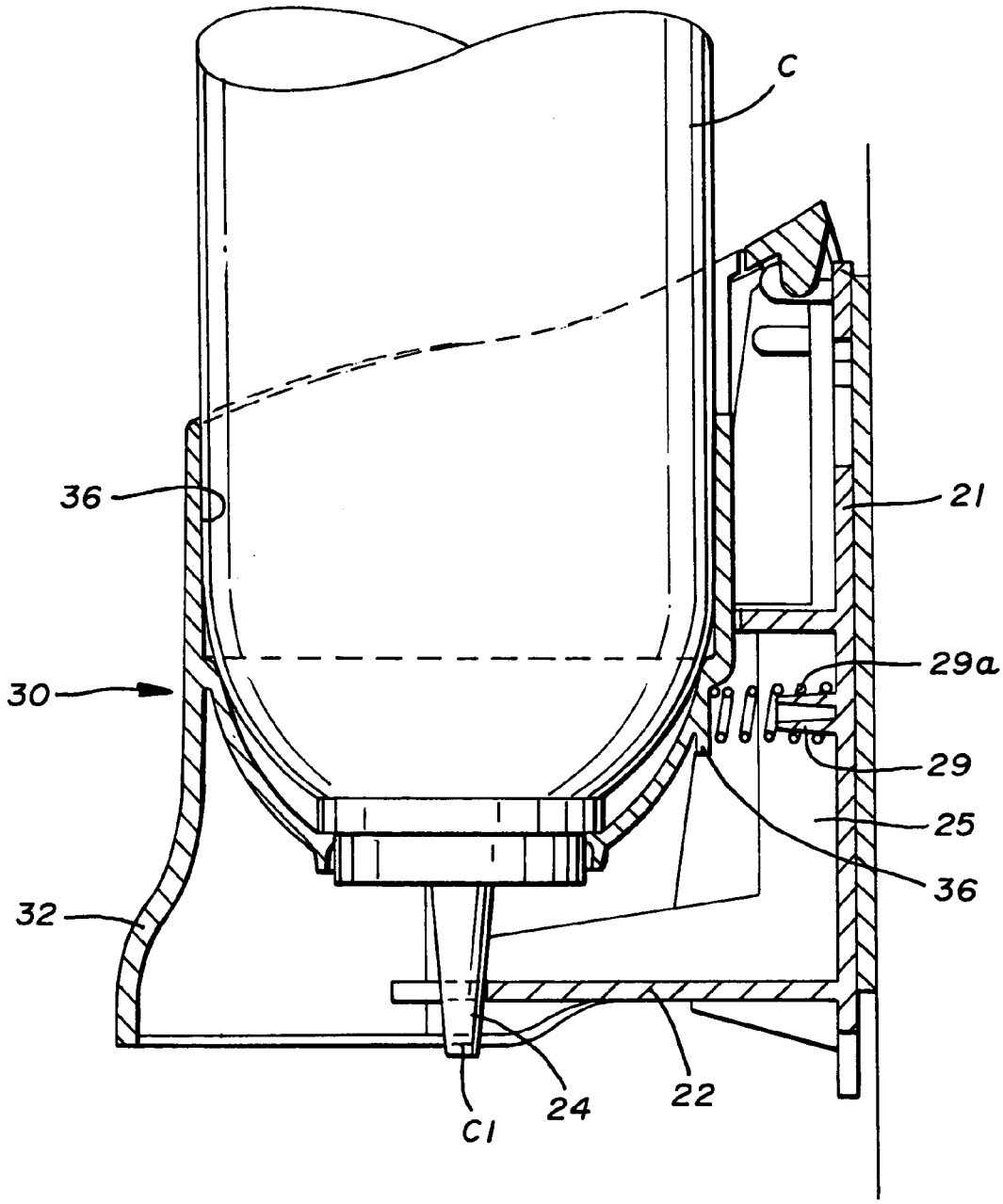
FIG. 7 is a sectional view similar to FIG. 6 showing a modified form of the invention.

FIG. 7 illustrates a modified form of the invention in which similar components have been assigned like numbers. In the form of the invention shown in FIGS. 1–6 of the drawings, it has been illustrated and described how hand pressure against the outer arcuate surface 32 of the holder 11 causes the entire holder to pivot about the axles 25*a* and move toward the rear wall. As this occurs, nozzle C1 presses against the edge of the notch 24 of the back plate to deflect the nozzle to discharge the material. When pressure is released from the surface 32, the resiliency of the nozzle will cause the holder to pivot back to the starting position.

This arrangement is entirely satisfactory for most units of this type. However, it has been found that when very large containers C are employed, the weight of the container and the contents thereof is such that it is possible that the nozzle will not have enough strength to fully return the holder to the start position.

Accordingly, FIG. 7 illustrates a modified form of the invention in which all of the components are essentially similar except as will now be described.

To that end, the back plate 21 is provided with a stub projection 29 which projects outwardly toward the holder as can be seen in FIG. 7.

This serves as a seat for a spring 29*a*. The holder is slightly modified also to provide a flat surface 36 adjacent the bottom thereof to provide a seat for the opposed end of the spring 29*a*.

In this fashion, not only will the inherent strength of the nozzle C1 assist in returning the holder to the start position, but the spring 29 also will do so and assist this movement. This enables the invention to be utilized with very large size containers without effecting the operation thereof.

While a full and complete description of the invention has been set forth in accordance with the dictates of the patent statutes, it should be understood that modifications can be resorted to without departing from the spirit hereof or the scope of the appended claims.

What is claimed is:

1. A container holder assembly for holding a product dispensing container which has a flexible dispensing nozzle disposed on one end thereof, comprising:

1) a back plate having a first leg with first and second ends and a second leg with said second leg projecting substantially normally from said second end of said back plate;

2) said second leg having a notched recess extending inwardly from its distal peripheral surface for receipt of the flexible nozzle;

3) a container holder having a top and bottom end and a through vertical bore extending from said top end to said bottom end for receipt of the container and a planar external planar surface portion;

4) said top end of said container holder being hingedly attached to said first end of said first leg of said back plate; and 5) said through bore of said container holder having a central axis which extends from said bottom end to said top end of said holder body away from the plane of said external planar surface whereby upon insertion of the container into said through bore and the flexible nozzle into said notched recess movement of said container holder body about its hinged point of connection with said with said back plate will cause deflection of the flexible nozzle and dispensing of the product.

2. The container holder assembly of claim 1 wherein said first leg of said back plate has opposed projections centrally disposed on said first leg adjacent said first end thereof; and said container holder has a projecting rib adjacent its top end and extending between said projection when said container holder is hingedly attached to said back plate.

3. The container holder assembly of claim 1 wherein said container holder is releasably attached to said back plate.

4. A container holder assembly for removably receiving a product dispensing container having a flexible dispensing spout, comprising:

1) a back plate having a longitudinal axis; and 2) a container holder hingedly attached to said back plate for receipt of the container so that the container is disposed at an angle with respect to the longitudinal axis of said back plate; and 3) said holder being movable toward and away from said back plate to move the flexible nozzle into and away from contact with said back plate.

5. The container holder of claim 4 wherein said container holder is releasably attached to said back plate.

6. The container holder assembly of claim 4 wherein said back plate comprises first and second legs and said nozzle contacts a portion of said second leg upon movement of said holder relatively of said back plate.

7. The container holder assembly of claim 6 wherein said second leg projects normally from said first leg of said holder and a nozzle receiving notch is formed on its distal edge.

8. The container holder assembly of claim 7 wherein said first leg has centrally disposed, opposed projections on one surface; said container holder has a centrally disposed projecting rib projecting between said opposed projections when said container holder is hingedly attached to said back plate.

9. A container holder assembly for removably receiving a product dispensing container having a flexible dispensing spout, comprising:

1. a back plate having a longitudinal axis;

2. a container holder hingedly attached to said back plate for receipt of the container so that the container is disposed at an angle with respect to the longitudinal axis of the back plate;

3. said holder being movable toward and away from said back plate for move the flexible nozzle into and away from contact with said back plate; and 4. spring means carried by the back plate for contacting said container holder for assisting in movement of the flexible nozzle away from said back plate.

10. The container holder of claim 9 wherein said container holder has a flat surface adjacent its lower end.

11. The container holder of claim 10 wherein said spring means includes a spring carried by said back plate in projecting relationship therewith and trapped between a spring seat on said container and said back plate.

* * * * *